United States Patent [19]

Chambers et al.

[11] 4,431,312

[45] Feb. 14, 1984

[54] RADIO ALARM CONVERTER

[75] Inventors: Worthy L. Chambers, 1035 Nottingham La., Hoffman Estates, Ill. 60195; Michael Krueser, Evanston, Ill.

[73] Assignee: Worthy L. Chambers, Hoffman Estates, Ill.

[21] Appl. No.: 332,148

[22] Filed: Dec. 28, 1981

[51] Int. Cl.[3] ..... G04B 47/00

[52] U.S. Cl. ..... 368/10

[58] Field of Search ..... 368/10, 12, 250, 251; 307/141, 141.4; 340/309.1, 309.4

[56] References Cited

U.S. PATENT DOCUMENTS

| | | | |
|---|---|---|---|
| 2,771,559 | 11/1956 | Montmeat | 368/10 |
| 3,361,973 | 1/1968 | Wysong | 368/12 |
| 3,949,240 | 4/1976 | Saito et al. | 368/12 |

*Primary Examiner*—Vit W. Miska

*Attorney, Agent, or Firm*—Trexler, Bushnell & Wolters, Ltd.

[57] ABSTRACT

A radio alarm converter is provided for energizing a radio in response to an alarm signal from a clock, which clock normally provides an alarm signal not usable for energizing said radio. The radio alarm converter comprises a signal conversion circuit coupled intermediate the radio and the clock and responsive to the alarm signal for delivering an energizing current to the radio.

14 Claims, 6 Drawing Figures

FIG. 1
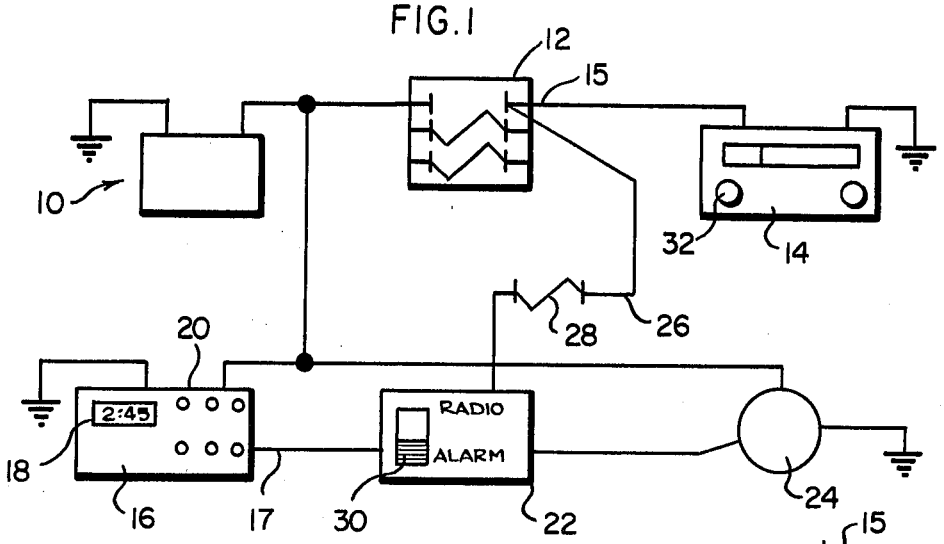
FIG. 2
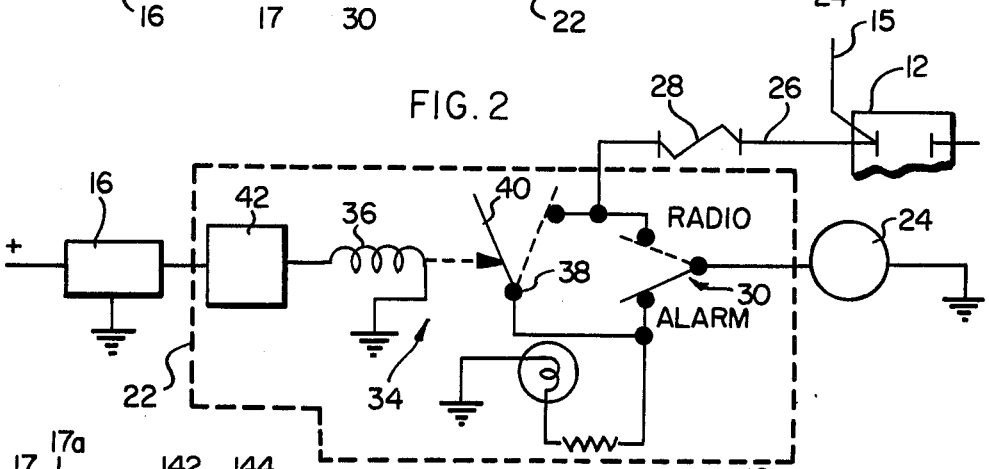
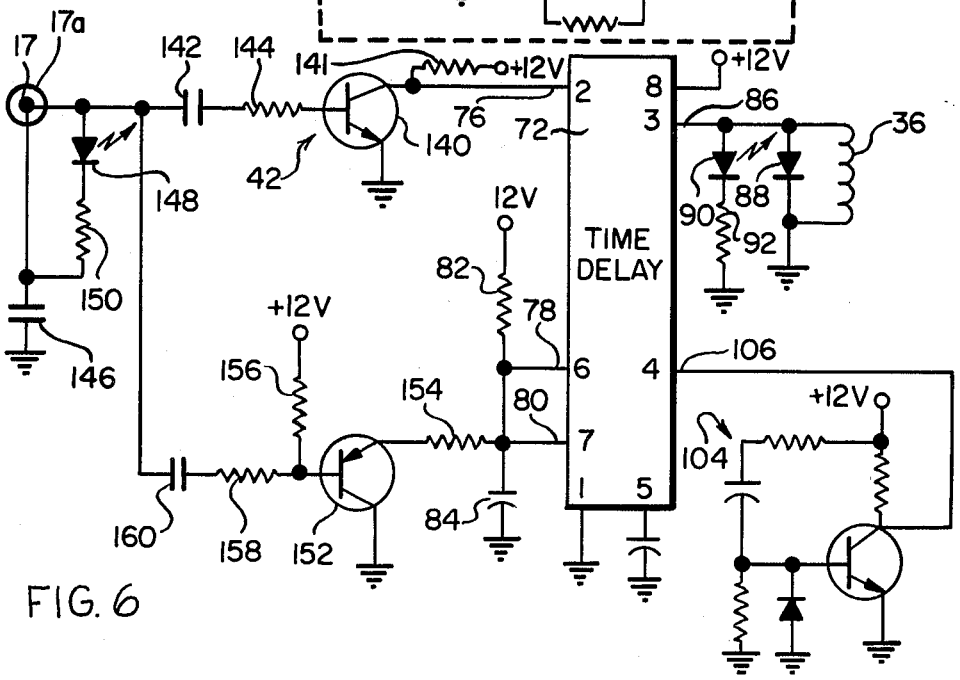
FIG. 6

+12V
RADIO
+14V
ALARM
TIME DELAY

RADIO ALARM CONVERTER

BACKGROUND OF THE INVENTION

The present invention is directed generally to an electronic circuit for converting one type of electrical signal to another type of electrical signal, and more specifically to such an electronic circuit which converts an alarm signal from an alarm clock to a suitable signal level for energizing a conventional radio.

The invention is particularly useful in conjunction with a radio and an alarm clock which respectively normally operate from a DC source, for example the 12-volt system of a conventional automotive vehicle. Similar DC current systems are found in many automotive vehicles, recreational vehicles, campers, and boats. Hence, the present invention is equally useful in conjunction with any of the foregoing.

Conventional radios provided for operating from a DC source such as a 12volt automotive vehicle electrical system are well known. Additionally, DC operated alarm clocks are now available for use in automotive vehicles, and are similarly adapted to be operated from the vehicle 12-volt electrical system. However, these alarm clocks are presently provided with a buzzer or other similar audible alarm device and have no provision for energizing the vehicle radio to act as an alarm. These buzzers or other audible alarms generally require but a minimal signal voltage and current level for operation. Accordingly, the alarm clocks presently available provide such a low voltage, low current alarm signal output for energizing such a buzzer or other audible device. Consequently, the alarm signals produced by these digital alarm clocks are not suitable for energizing a conventional automotive vehicle radio.

Additionally, several types of alarm clocks are available which produce different types of alarms by producing output signals of different signal levels and polarities. For example, some digital alarm clocks provide an approximately 12-volt constant DC, low current signal to the alarm buzzer for a predetermined period upon reaching a preselected time, thereby sounding the buzzer continuously for some predetermined interval. Other digital alarm clocks and associated buzzers operate on a negative polarity signal. Still other alarm clocks produce a fixed DC level, pulsing signal to provide a pulsing buzzer or alarm sound. Moreover, these pulsing type of alarms may be at any of a plurality of different rates.

It will be appreciated from the foregoing that an alarm converter for energizing a radio for constant play at least over some predetermined period in response to an alarm signal from any of the foregoing types of alarm clocks is difficult to provide. Since none of the alarm clocks heretofore in use produce an alarm output signal suitable for directly driving a typical automotive vehicle radio, however, such a converter device must be utilized to obtain "radio" alarm.

OBJECTS AND SUMMARY OF THE INVENTION

Accordingly, it is a general object of the invention to provide a radio alarm converter responsive to an alarm signal from a DC-powered alarm clock for energizing a separate, DC-powered radio.

A related object is to provide a converter of the foregoing type which may be relatively easily coupled with a conventional DC-powered alarm clock and a DC-powered radio without requiring modification to either.

A further object is to provide a converter of the foregoing type which is relatively simple to install in a conventional automotive vehicle or the like, even by a relatively unskilled person.

Briefly, and in accordance with the foregoing objects, a radio alarm converter is provided for energizing a radio in response to an alarm signal from a clock, said clock normally providing an alarm signal not usuable for energizing said radio. In accordance with the invention, the radio alarm converter comprises a signal conversion circuit coupled intermediate said radio and said clock and responsive to said alarm signal for delivering an energizing current to said radio.

BRIEF DESCRIPTION OF THE DRAWINGS

Other objects, features and advantages of the invention will become more readily apparent upon reading the following detailed description of the illustrated embodiment, together with reference to the drawings, wherein:

FIG. 1 is a circuit diagram in block form illustrating a conventional automotive vehicle electrical system including a clock and a radio, and illustrating the radio alarm converter of the invention coupled in circuit therewith;

FIG. 2 is a schematic circuit diagram, partially in block form, further illustrating the operation of the radio alarm converter of the invention;

FIG. 6 is a schematic circuit diagram of an alternate embodiment of the circuit of FIG. 3.

DETAILED DESCRIPTION OF THE ILLUSTRATED EMBODIMENT

Figures 3, 4, 5:
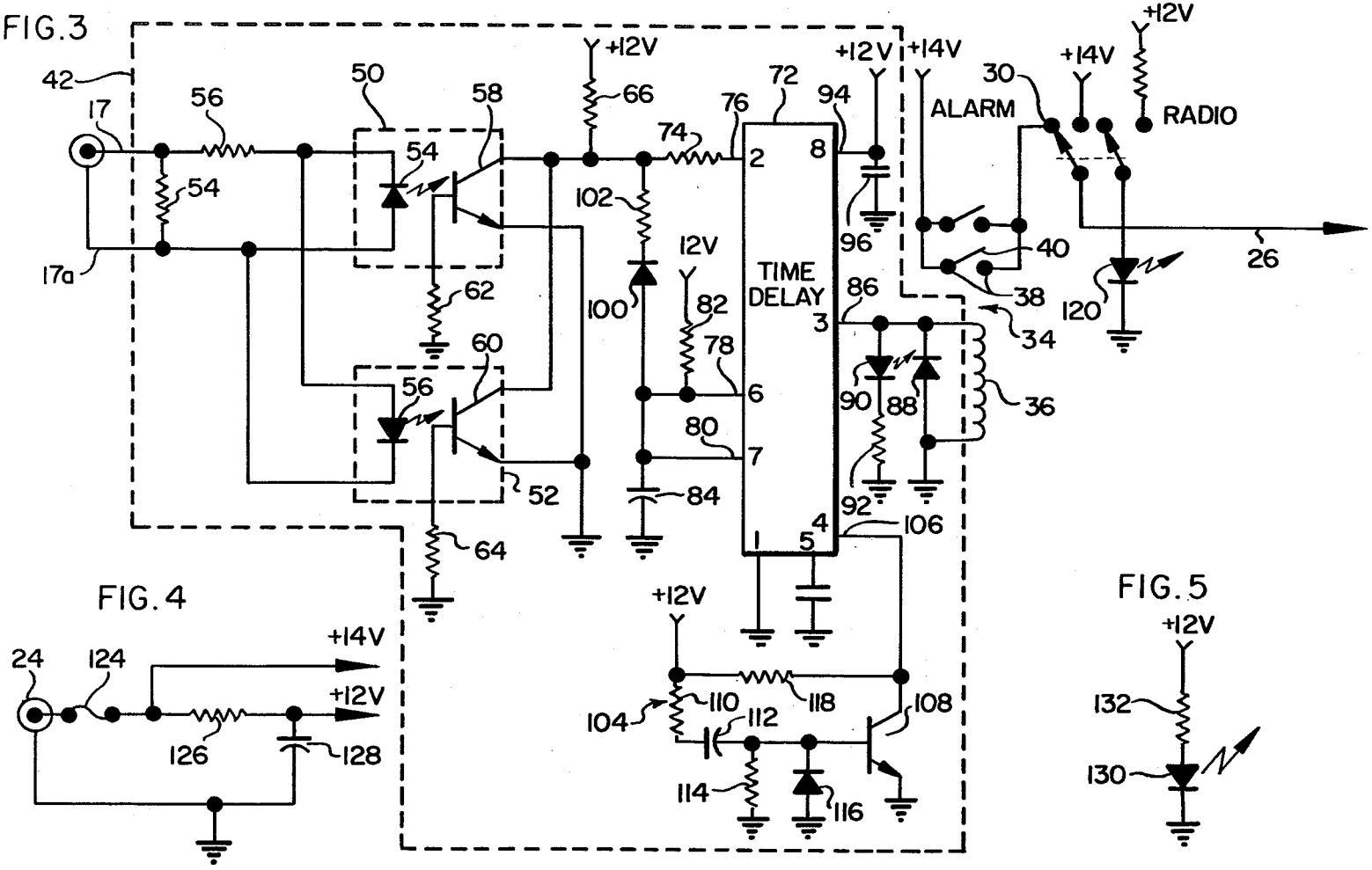
FIG. 3 is a detailed schematic circuit diagram of the radio alarm converter of the invention.
FIG. 4 is a circuit schematic diagram of a power source for the circuit of FIG. 3.
FIG. 5 is a schematic circuit diagram of an indicator device in accordance with a preferred feature of the invention.

Referring now to the drawings and initially to FIG. 1, there is seen a block schematic diagram of a typical automotive vehicle electrical system including a battery 10. In the illustrated embodiment, this battery 10 comprises a conventional 12-volt DC battery, although other voltage DC batteries may be readily accommodated in accordance with the principles of the invention. This battery 10 supplies DC power to a number of electrical components of the automotive vehicle by way of a suitable fuse box 12. One such component comprises a radio 14 which is coupled with one output terminal 15 of the fuse box 12, associated with the fuse normally provided for the radio 14.

A DC-powered alarm clock 16 is also coupled both to receive DC power from the battery 10 and to a suitable ground point in the vehicle. The clock 16 has an alarm signal output line 17, to be described later. This alarm clock 16 may comprise a digital clock having digital display characters 18 and a plurality of controls 20 for setting the time, setting a desired alarm time, and the like.

Departing from convention, and in accordance with the invention, a radio alarm converter 22 is coupled with the line 17 from the alarm clock 16 and with a suitable source of 12-volt DC power. This source of power may be taken from any convenient point in the vehicle electrical system. However, for convenience of installation, in the illustrated embodiment the DC power for the converter 22 is taken from a cigar lighter 24 which is usually conveniently accessible in the dashboard of the vehicle.

The radio alarm-converter 22 of the invention is also coupled to the positive DC power input terminal of the radio 14 by any suitable means. Again, to aid in ease of installation, in the illustrated embodiment, this circuit is completed by way of a suitable cable 26 which includes a fuse 28 coupled therein, to the same terminal 15 of the fuse box 12 which normally feeds the radio 14.

In accordance with the invention, the fuse normally provided in fuse box 12 feeding the terminal 15 is removed, whereby the radio 14 receives DC power only from the radio alarm converter 22 of the invention. In this regard, a suitable radio-alarm selector switch 30 is provided in the radio alarm converter unit 22 for selecting either normal operation of the radio, or operation of the radio in response to an alarm signal from the alarm clock 16. Accordingly, when the radio-alarm selector switch 30 is thrown to the "radio" position, the radio 14 may be operated in the normal fashion by actuation of an on-off/volume switch 32 thereof. However, when the switch 30 is thrown to the "alarm" position, the on-off/volume switch 32 of the radio 14 is left in its "on" position and at a desired volume level, and the radio 14 will only be turned on in response to the radio-alarm converter 22 when an alarm signal from the alarm clock 16 is detected.

In this regard, reference is also invited to FIG. 2, whereon the radio-alarm switch 30 is shown in circuit schematic form. In FIG. 2, the radio-alarm switch 30 is shown in its "alarm" position, the "radio" position thereof being shown in phantom line. This radio-alarm switch 30 has its common terminal fed directly from the source of DC power, which in the illustrated embodiment comprises the cigar lighter 24. Hence, in the "radio" position this DC power is fed directly by way of the cable 26 containing fuse 28 to the terminal 16 of the fuse box 12. Hence, DC power is in effect fed directly to the DC power input terminal of the radio 14, with the switch 30 in the radio position.

The radio-alarm converter 22, as shown in FIG. 2, also includes switching means, which in the illustrated embodiment takes the form of a relay 34 which comprises a relay coil 36 and a normally open pair of relay contacts or terminals 38. A movable contactor 40 is responsive to the relay coil 36 for selectively closing the circuit between the normally open relay terminals 38. It will be noted that with the switch 30 in the "alarm" position, DC power is fed to one side of the normally open relay contacts 38, whereby closure of the relay contactor 40 in response to energization of the coil 36 delivers this DC power to the cable 26 and thence to the radio 14 as previously described.

The coil 36 is in turn energized and de-energized, respectively, by the action of a control circuit 42 in accordance with the invention. This control circuit 42 is also coupled to an alarm signal output line 17 of the alarm clock 16.

The alarm clock 16 normally provides an alarm signal output on the line 17 for energizing a low-current buzzer or the like (not shown). This alarm signal 17 is therefore a relatively low voltage, low current signal and may be either a constant DC level or a pulsing DC signal to produce a constant or a pulsating sound from the buzzer or the alarm. Hence, this signal is not suitable for energizing the radio 14 which conventionally requires a greater current at 12 volts DC. In accordance with a feature of the invention, and as will be more fully described hereinbelow, the radio-alarm converter 22 is responsive to either a constant DC level alarm signal on the line 17 of from on the order of 2 volts DC to 12 volts DC, or a pulsating signal of the same range of levels and at a rate of from on the order of substantially 1 hertz to 2 kilohertz for energizing the radio 14. In this regard, the radio-alarm converter 22 responds to either a positive or negative polarity alarm signal on the line 17 in this fashion.

Reference is next invited to FIG. 3, wherein the circuit 42 is illustrated in detail in circuit schematic form. The alarm signal line 17 comprises a pair of complementary signal lines 17 and 17*a* which feed one input to the circuit 42. These lines 17, 17*a*, respectively, feed a pair of opto-isolator components 50, 52 which are arranged with opposite polarities. A suitable resistor 54 is provided across the lines 17, 17*a* and a suitable resistor 56 is provided in series between the line 17 and one side of each of the respective opto-isolators 50, 52. In accordance with a feature of the invention, the arrangement of the opto-isolators 50 and 52 in opposite polarity ensures response of the circuit 42 to an alarm signal of either polarity produced by the alarm clock 16 across the lines 17, 17*a*. In the illustrated embodiment, the opto-isolators 50 and 52 each comprises a circuit component of the type generally designated 4N35 and including a light-emitting diode (LED) 54, 56 and a photo-responsive transistor 58, 60. The respective base electrodes of the photo-responsive transistors are referenced to ground by suitable resistors 62, 64, respectively.

Collector current is provided to the respective transistors 58, 60 from a suitable +12 volt DC source by way of a suitable resistor 66. The emitters of the respective transistors 58 and 60 are tied to ground. The collector electrodes of both transistors 58 and 60 are tied together and form the outputs of the respective opto-isolators 50, 52. This common output feeds the remainder of the circuit 42 which comprises a timer or time delay integrated circuit component 72. In this regard, a suitable resistor 74 feeds a trigger terminal 76 of the time delay circuit 72 from the output of the opto-isolators 50, 52.

In the illustrated embodiment, this timer or time delay circuit 22 comprises an integrated circuit component of the type generally designated 555, and is coupled in circuit with components to be described below so as to function essentially as a monostable multivibrator. In this regard, a pair of timing control terminals 78, 80 of the circuit 72 are coupled together and provided with a suitable RC characteristic by a resistor 82 coupled to the +12 volt DC source and a capacitor 84 coupled to ground. An output terminal 86 of the circuit 72 feeds the coil 36 of the relay 34 whose opposite end is tied to circuit ground. This signal to the coil 36 is adjusted in conventional fashion by the provision of a despiking diode 88 thereacross. A light emitting diode (LED) 90 and current limiting resistor 92 may also be provided in series from the terminal 86 to ground to give a visual indication of the energization of the solenoid coil 36 and hence of the radio 14. The positive 12-volt source is fed to supply terminal 94 of the circuit 76 which is also provided with a suitable capacitor 96 to ground.

In operation, the timer or time delay circuit 72 responds to a negative-going input signal at the terminal 76 when the magnitude of this signal reaches approximately one-third of the positive voltage supply. When triggered by this signal level at the terminal 76, the output terminal 86 of the circuit 72 goes into its active or high state, energizing the coil 36. This condition continues throughout the time delay given by the resistor 82 and capacitor 84 which is on the order of 1.1 RC. In the illustrated embodiment, the resistor 82 is on the order of 100K ohms while the capacitor 84 is chosen on the order of 10 microfarads. Hence, the time delay is substantially on the order of 1.1 seconds.

A diode 100 and resistor 102 run in series from the coupled terminals 78 and 80 back to the junction of resistor 74 with the respective outputs of the opto-isolators 50 and 52. This allows the capacitor 84 to discharge to permit retriggering of the time delay circuit 72 in the foregoing fashion for each subsequently received negative going signal from either of the opto-isolators 50 or 52. Accordingly, the time delay circuit 72 will repeatedly retrigger and hold its output terminal 86 in an active state and hence continuously energize the coil 36 in response to signals of either polarity received at the inputs of the respective opto-isolators 50, 52 when these signals are pulsing DC signals at any rate from substantially 1 Hz to substantially 2 Khz.

An additional reset circuit 104 is provided at a reset terminal 106 of the timer or time delay circuit 72. Briefly, an NPN transistor 108 has its collector terminal tied to this reset terminal 106. The emitter electrode of this transistor 108 is grounded while the base electrode thereof is coupled to the positive 12-volt supply by way of the series-coupled combination of a suitable resistor 110 and suitable capacitor 112. The base electrode of the transistor 108 is also referenced to ground by a suitable resistor 114 and by a diode 116. A resistor 118 is coupled from the collector electrode of the transistor 108 to the +12 volt positive supply. From the foregoing, it will be seen that the transistor 108 and associated circuitry provides a suitable reset or timing signal, determined by the choice of circuit RC components, to the reset terminal 106. This circuit 104 thus assures proper operation of the timing circuit 72 for continuously energizing the coil 36 in response to an alarm signal. In the illustrated embodiment, resistors 110 and 118 are chosen at 10K ohms, resistor 114 at 2.2K ohms and capacitor 112 at 1.0 microfarads.

As illustrated in FIG. 3, the normally open contacts 38 and movable contactor 40 of the relay 34 receive a positive 14 volts supply, and feed the radio by way of the selector switch 30 as previously described. Additionally, a suitable indicator such as an LED 120 may be provided to indicate the mode of operation selected by the selector switch 30. In this regard, this switch 30 is ganged with a second similar single pole, single throw switch which feeds the LED 120. When the switch 30 is in the "alarm" mode the LED 120 is held in an open circuit condition, while when the switch 30 is in the "radio" mode the LED 120 is energized from the positive 12-volt supply. In FIG. 3, this switch 30 is illustrated in the "alarm" position.

Referring briefly to FIG. 4, a suitable circuit for providing the positive 12-volt DC and positive 14-volt DC supplies is illustrated. This circuit is coupled with the positive 12-volt DC voltage from the vehicle electrical system and preferably by the simple expedient of coupling to the cigar lighter 24. A fuse 124 may be provided in series with the positive or hot side of the cigar lighter 24 and directly feeds the +14 volt supply line. A suitable resistor 126 is provided from the fuse to the positive 12-volt supply line which further is provided with a suitable capacitor 128 running to the ground side of the cigar lighter 24.

Referring briefly to FIG. 5, the proper connection of the circuits of the invention may optionally be verified to the user by the provision of a simple LED 130 and suitable series-coupled current limiting resistor 132 from the +12 volt supply output of the circuit of FIG. 4. Hence, it can be readily verified that this positive supply line has been properly coupled with the cigar lighter 24 or any other suitable point in the vehicle electrial system by the lighting of the LED 130.

Referring briefly to FIG. 6, an alternative embodiment of the circuit of FIG. 3 is illustrated. In the embodiment of FIG. 6, this circuit is intended to operate in response to an alarm signal which is a DC pulsing signal. To this end, the input circuits are somewhat simpler than those illustrated and described above with reference to FIG. 3. The alarm output terminals **17, 17*a* feed the base electrode of a PNP bipolar transistor 140 by way of the series combination of a capacitor 142 and a resistor 144. The emitter electrode of the transistor 140 is tied to ground and a suitable pullup resistor 141 is provided at the collector electrode thereof. The low or ground line 17*a* from the alarm output terminal of the clock 16 is tied to ground by way of a suitable capacitor 146. Optionally, an LED 148 and current limiting resistor 150 may be placed in series between the high and low side 17, 17*a* of the alarm output terminal. Flashing of this LED 148 in response to the above-described pulsing DC alarm signal will serve as a visual indication of the giving of an alarm, and hence as a check on the proper operation of the circuit 42 of FIG. 6 in energizing the radio 14** in response to such an alarm.

The timing integrated circuit 72 is preferably of the type generally designated 555, the same as that described above with reference to FIG. 3. The terminals of this timing circuit 72 are the same as their liked numbered counter parts described above with reference to FIG. 3. In this regard, the input terminal 76 is fed from the collector electrode of the transistor 140 and the output terminal 86 energizes the solenoid 36 to in turn energize the radio 14. The remaining contacts of the solenoid 36 and connections to the radio have not been repeated in FIG. 6.

The timing terminals 78 and 80 receive the same resistor 82 and capacitor 84, selected to give substantially a 1.1 second time delay, in the same fashion as described above with reference to FIG. 3. Additionally, a reset or timing circuit 104 is provided to the reset terminal 106 of the timer integrated circuit 72, and includes the same components and performs same function as the same circuit described above with reference to FIG. 3.

Departing somewhat from the circuit of FIG. 3, a second, PNP bipolar transistor 152 has its emitter terminal joined to the junction of terminals 78 and 80 of the timer circuit 72 by way of a suitable series connected resistor 154. The collector electrode of the transistor 152 is grounded. The base electrode of the transistor 152 is provided with a voltage pullup resistor 156 and is coupled to the alarm output terminal 17 by way of a series coupled resistor 158 and capacitor 160.

In operation, the circuit of FIG. 6 functions substantially identically to the circuit of FIG. 3 in maintaining the solenoid coil 36 energized and hence the power circuit close to the radio 14 in response to a DC pulsing alarm signal at a rate of between substantially 1 Hertz and substantially 2K Hertz.

What has been illustrated and described above is a novel radio alarm converter for use with a conventional automotive radio and automotive alarm clock. While the invention has been illustrated and described herein with reference to a preferred embodiment is not limited thereto. Those skilled in the art may devise various alternatives, changes and modifications upon reading the foregoing descriptions. The invention includes such alternatives, changes and modifications insofar as they fall within the spirit and scope of the appended claims.

The invention is claimed as follows:

1. A radio alarm converter for energizing a radio in response to an alarm signal from a clock normally not operatively coupled to said radio, said clock normally providing an alarm signal not usable for energizing said radio, and a current source being provided for normally energizing said radio, said radio alarm converter comprising: switching means coupled intermediate said radio and said current source and actuatable for delivering energizing current from said current source to said radio, and control circuit means coupled to receive said alarm signal and responsive thereto for actuating said switching means, thereby energizing said radio in response to said alarm signal; wherein said control circuit means includes input circuit means responsive to said alarm signal for producing a control signal of predetermined polarity and output circuit means responsive to said control signal for actuating said switching means; wherein said input circuit means produces a control signal which has a predetermined DC level and both active and inactive states, the state thereof being determined by the DC level of said alarm signal; and wherein said output circuit means includes timing means responsive to both a substantially constant DC level control signal and to a DC pulse control signal at a rate of between substantially 1 Hz and substantially 2 KHz for maintaining said switching means continuously actuated, thereby energizing said radio in response to both a constant DC level alarm signal and a DC pulsed alarm signal at a rate of between substantially 1 Hz and substantially 2 KHz.

2. A radio alarm converter for energizing a radio in response to an alarm signal from a clock normally not operatively coupled to said radio, said clock normally providing an alarm signal not usable for energizing said radio, and a current source being provided for normally energizing said radio, said radio alarm converter comprising: switching means coupled intermediate said radio and said current source and actuatable for delivering energizing current from said current source to said radio, and control circuit means coupled to receive said alarm signal and responsive thereto for actuating said switching means, thereby energizing said radio in response to said alarm signal; wherein said control circuit means includes input circuit means responsive to said alarm signal for producing a control signal of predetermined polarity and output circuit means responsive to said control signal for actuating said switching means; and wherein said input circuit means comprises polarity and level conversion means for converting an alarm signal of either polarity and of a level over a predetermined range to a control signal of predetermined polarity and level.

3. A radio alarm converter according to claim 2 wherein said input circuit means produces a control signal which has a predetermined DC level and both active and inactive states, the state thereof being determined by the DC level of said alarm signal and wherein said output circuit means includes timing means responsive to both a substantially constant DC level control signal and to a DC pulsed control signal at a rate of between substantially 1 Hz and substantially 2 KHz for maintaining said switching means continuously actuated, thereby energizing said radio in response to both a constant DC level alarm signal and a DC pulsed alarm signal at a rate of between substantially 1 Hz and substantially 2 KHz.

4. A radio alarm converter according to claim 1 and further including function selection switch means for selectively coupling said radio to one of said radio current source and said radio alarm converter for selecting one of normal radio operation and radio operation in response to said alarm signal.

5. A radio alarm converter according to claim 3 wherein said timing means comprises time delay circuit means coupled in circuit as a monostable multivibrator.

6. A radio alarm converter according to claim 5 wherein said input circuit means comprises polarity and level conversion means for converting an alarm signal of either polarity and of a level over a predetermined range to a control signal of predetermined polarity and level.

7. A radio alarm converter according to claim 5 wherein said polarity and level conversion means comprises a pair of opto-isolators, each coupled in circuit to operate in response to one polarity of said alarm signal.

8. A radio alarm converter according to claim 1 or claim 3 wherein said switching means comprises relay means including a relay coil coupled for response to said control circuit means and a normally open pair of relay contacts coupled intermediate said radio and said current source.

9. A radio alarm converter for energizing a radio in response to an alarm signal from a clock, said clock normally providing an alarm signal not usable for energizing said radio, said radio alarm converter comprising: input circuit means coupled to receive said alarm signal and responsive thereto for producing a control signal and output circuit means coupled to said input circuit means and to said radio and responsive to said control signal for providing energizing current to said radio; wherein a current source is provided for normally energizing said radio; wherein said output circuit means includes switching means coupled intermediate said radio and said current source for controlling delivery of energizing current from said current source to said radio and control circuit means coupled to said input circuit means and responsive to said control signal for actuating said switching means to deliver said energizing current to said radio; wherein said input circuit means produces a control signal at a predetermined level and having an active and inactive state, the state of said control signal being determined by the DC level of said alarm signal; and wherein said control circuit means includes timing means responsive to a DC pulsed control signal at a rate of between substantially 1 Hz and substantially 2 KHz for maintaining said switching means continuously actuated, thereby energizing said radio in response to a DC pulsed alarm signal at a rate of between substantially 1 Hz and substantially 2 KHz.

10. A radio alarm converter according to claim 9 wherein said output circuit means comprises time delay circuit means coupled in circuit as a monostable multivibrator.

11. A radio alarm converter according to claim 9 wherein said input circuit means comprises level conversion means for converting an alarm signal of a level over a predetermined range to a signal of predetermined level.

12. A radio alarm converter according to claim 11 wherein said level conversion means comprises a pair of opto-isolators, each coupled in circuit to operate in response to one polarity of said alarm signal.

13. A radio alarm converter according to claim 11 wherein said level conversion means comprises a bipolar transistor.

14. A radio alarm converter according to claim 9 or claim 13 wherein said switching means comprises relay means including a relay coil coupled to said control circuit means and a normally open pair of relay contacts coupled intermediate said radio and said current source.

* * * * *

UNITED STATES PATENT AND TRADEMARK OFFICE

CERTIFICATE OF CORRECTION

PATENT NO. : 4,431,312

DATED : February 14, 1984

INVENTOR(S) : Worthy L. Chambers and Michael Krueser

It is certified that error appears in the above-identified patent and that said Letters Patent is hereby corrected as shown below:

Column 8, line 22, change "claim 3" to --claim 1--.

Column 8, line 31, change "claim 5" to --claim 6--.

Column 10, line 7, change "claim 13" to --claim 11--.

Signed and Sealed this

*First* Day of *January 1985*

[SEAL]

*Attest:*

GERALD J. MOSSINGHOFF

*Attesting Officer*

*Commissioner of Patents and Trademarks*